US006648723B2

(12) United States Patent
Clark, Jr. et al.

(10) Patent No.: US 6,648,723 B2
(45) Date of Patent: Nov. 18, 2003

(54) BODYSLAMMERS TOY RACING VEHICLES

(76) Inventors: Leonard R. Clark, Jr., 128 Waldy Ave., Oreland, PA (US) 19075; H. Peter Greene, 12 Wards Way, Boyertown, PA (US) 19512

( * ) Notice: Subject to any disclaimer, the term of this patent is extended or adjusted under 35 U.S.C. 154(b) by 55 days.

(21) Appl. No.: 10/043,340

(22) Filed: Jan. 14, 2002

(65) Prior Publication Data

US 2002/0094751 A1 Jul. 18, 2002

Related U.S. Application Data

(60) Provisional application No. 60/261,187, filed on Jan. 16, 2001.

(51) Int. Cl.[7] ..... A63H 18/00
(52) U.S. Cl. ..... 446/444; 446/471
(58) Field of Search ..... 446/431, 433, 446/437, 441, 444, 445, 446, 465, 470, 471, 467, 90, 93–95, 469

(56) References Cited

U.S. PATENT DOCUMENTS 4,540,377 A * 9/1985 Rehkemper et al. ..... 446/430
4,643,102 A * 2/1987 Arnau Manresa ..... 104/305
4,764,150 A * 8/1988 Uchino ..... 446/456
4,795,154 A * 1/1989 Lahr ..... 273/86 B
4,986,789 A * 1/1991 Hang ..... 446/93
5,342,048 A * 8/1994 Jones et al. ..... 273/86 B
5,980,358 A * 11/1999 Diller ..... 446/467

* cited by examiner

*Primary Examiner*—Jacob K. Ackun
*Assistant Examiner*—Jamila Williams
(74) *Attorney, Agent, or Firm*—Michael de Angeli

(57) ABSTRACT

Toy racing vehicles for operating on preexisting track of a particular scale comprise sub bodies including conventional chassis and larger-scale "visible cars", which are supported by the sub bodies, but are not fixed or mounted thereto. Instead, a visible car simply rests on the sub body, and is retained loosely thereon by one or more guide pins mounted on the sub body, and fitting loosely within apertures in a plate fixed with respect to the visible car. Accordingly, when the larger-scale visible cars bump one another during racing, they can be jostled out of their normal positions on their sub bodies, but are not separated therefrom, and return to their normal positions when the contact ceases. Realistic and exciting racing action results.

16 Claims, 3 Drawing Sheets

BODYSLAMMERS TOY RACING VEHICLES

CROSS-REFERENCE TO RELATED APPLICATION

This application claims priority from provisional application Ser. No. 60/261,187, filed Jan. 16, 2001.

FIELD OF THE INVENTION

This invention relates to toy racing cars and other vehicles. More particularly, the invention relates to toy racing cars, trucks, and motorcycles having improved realism and better play value than prior toy racing equipment.

BACKGROUND OF THE INVENTION

The prior art shows numerous types of toy and model racing cars, trucks, and motorcycles adapted to run on tracks. Typically such "slot cars" have a guide pin or fin extending downwardly into a groove or "slot" formed in the track, which is commonly molded in plastic and provided in sectional, snap-together form. Such slot cars are typically propelled by DC motors driving their rear wheels. The motors are connected to "pick-up shoes" that slide along the upper surfaces of conductors disposed on or slightly proud of the track surface, on either side of the groove; the current supplied is varied to control the speed of the slot car. As far as known to the present inventors, any body provided (i.e., to resemble a particular model of car, truck or motorcycle) is normally intended to be fixed to the chassis which carries the motor, guide pin or fin, drive wheels, and pick-up shoes.

It is generally understood that the small size of the popular HO scale toy racing cars, e.g., as sold by Mattel Corporation, limits their toy value in several significant ways. One is simply that the small size of the toys makes it harder to see them than is the case with larger models, particularly given their very high speeds. Larger scale cars provide better play value, and of course these have been and are still available. Larger scale cars also provide more surface area for colorful paint schemes, simulating actual race cars that may be marketed as collector's items, and so forth. However, larger scale cars and their track cost more and take up much more space, and so the HO scale cars retain their popularity. There is also a large "installed base" of preexisting HO scale track and associated equipment. Accordingly, it would be desirable to provide larger cars that could run on existing HO scale track; of course, it would be trivial to make the cars slower, increasing their visibility, but heretofore there has been no suggestion of any way to make them larger and still allow them to run on HO scale track, particularly if they are to be able to overtake one another, as required for realistic racing action.

SUMMARY OF THE INVENTION

According to the present invention, larger-scale "visible cars" are supported by "sub bodies" comprising drive chassis corresponding to smaller-scale cars. The visible cars are not fixed or mounted to the sub bodies. Instead, each visible car simply rests on the corresponding sub body, and is retained loosely thereon. Cooperating features formed on the visible car and sub body urge the visible car toward a normal attitude with respect to the sub body. These features may include one or more guide pins mounted on the sub body, which fit loosely within corresponding apertures in a plate fixed with respect to the visible car. In a first embodiment, at least one of the guide pins is conical in shape, and fits within a generally trapezoidal aperture in the plate. The conical shape of the pin cooperates with the trapezoidal aperture so that the visible car can be jostled substantially upwardly and sidewardly with respect to the sub body without being separated therefrom, for example when bumped by another car while racing. When the other car passes, the visible car is guided by the conical pin back into its normal orientation. A second cylindrical guide pin carried by the sub body and cooperating with an arcuate aperture in the plate limits the angular excursion of the visible car with respect to the sub body.

In a slightly modified second embodiment, the forward guide pin has a lower conical portion and an upper cylindrical portion, and again fits into a trapezoidal opening in a plate fixed to the visible car. In this embodiment, the rear guide pin comprises a flexible post, supported near its base by a guide member providing a self-centering action to the visible car, and a cap member fitting into a rectangular opening in the plate fixed to the visible car, and sized so that the visible car has to be rotated and tilted in a specific manner with respect to the sub body in order to remove the visible car from the sub body.

The result is that two racing cars, both occupying more than half the width of the track, can nonetheless pass one another without either being knocked off the track; instead, the visible cars are displaced temporarily with respect to the respective sub bodies, which remain engaged with the guide slot formed in the track surface. The result is exciting, large-scale racing action, with spectacular car-to-car contact.

BRIEF DESCRIPTION OF THE DRAWINGS

The invention will be better understood if reference is made to the accompanying drawings, in which:

FIGS. 1–5 relate to a first embodiment of the vehicles of the invention, and wherein:

FIG. 1 shows the visible car 10 lifted off the sub body 12, and illustrates the typical track 14;

FIG. 2 shows a side view of the visible car resting on the sub body;

FIG. 3 shows a plan view, with the body of the visible car not being shown; and FIGS. 4 and 5 are enlarged partial views corresponding to FIGS. 2 and 3, to enable dimensioning of important components.

DETAILED DISCLOSURE OF THE PRESENT INVENTION

According to the Body Slammers concept of the present invention, toy race cars intended for running on tracks of preexisting design, the track having been designed and manufactured for use with cars of a first relatively small scale, comprise relatively large-scale "visible cars" 10 adapted to be carried on smaller-scale "sub bodies" 12, fitting over chassis originally intended for cars intended to run on the smaller-scale track. That is, according to the concept of the invention, chassis manufactured to accept model car bodies of a first smaller scale are run on electrified track normally used for running of such cars of the first smaller scale, but are fitted with visible cars of much larger scale. Accordingly, such chassis and track can be manufactured using preexisting tooling, and can be operated using preexisting controllers; indeed, preexisting track, chassis, and controllers can be used. (In a particularly preferred embodiment, the chassis may be provided with different gear ratios.) However, according to the invention, such chassis are used as the principal components of "sub bodies", which are adapted according to the invention to accept visible cars of much larger scale.

Figure 1:
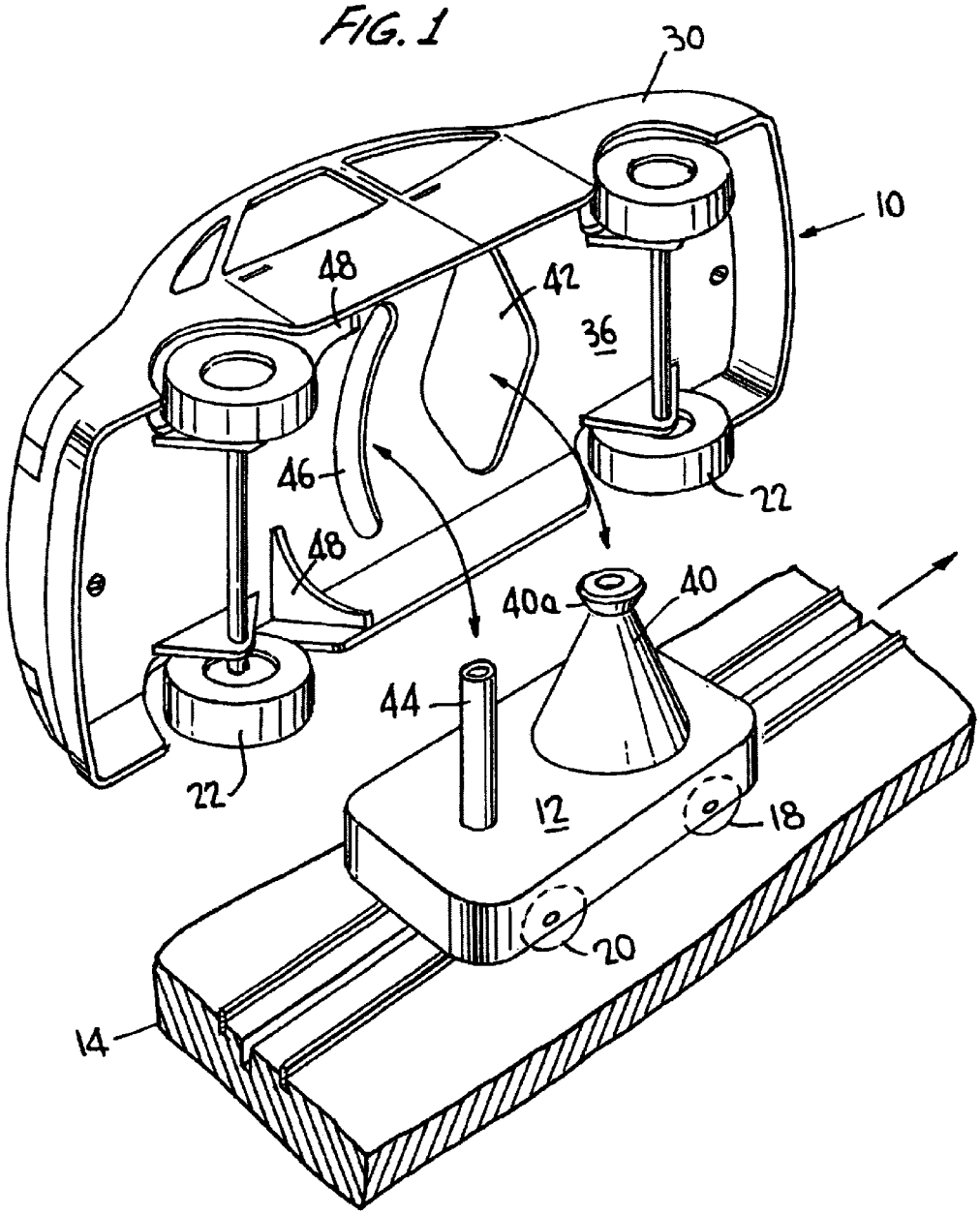

Unlike all prior art of which the inventors are aware, the visible cars 10 are not fixed to the respective sub bodies 12, but simply rest thereon, as illustrated by FIG. 1; this allows the large-scale cars thus provided, which otherwise could not pass one another on the smaller-scale track, to do so, and moreover with exciting action as the visible cars are jostled and bumped out of position, while the sub bodies remain relatively stable on the track. The result is much improved racing action with minimal additional tooling cost.

Therefore, the toy racing vehicle according to the invention comprises a visible car and a sub body, the sub body in turn comprising a chassis designed to run on a predetermined track designed for the operation of toy racing cars of a first scale, and wherein the visible car is of xm.zch larger scale, on the order of at least 200% larger scale In the preferred embodiment, the sub body 12 essentially comprises a chassis 16 of a preexisting "HO scale" slot racing car, e.g., as sold by Mattel Corporation, and the vehicles of the invention accordingly run on the track sold by Mattel for racing HO scale slot cars. Chassis 16 comprises a conventional motor 50, front and rear wheels 18 and 20 respectively, pickup shoes 24, and guide pin 26. The chassis may be concealed beneath a housing 28. See FIG. 2. Rear wheels 20 are driven by the motor, and propel the sub body 12 and thus the visible car; the visible wheels 22 provided as part of the visible car are dummies, and are rotated only by incidental drag along the surface of track 14. Preferably, as noted above, the gear set typically employed by preexisting HO-scale slot racing cars is regeared, to provide more torque, as the visible car 10 adds considerable weight; this slows the cars down and actually improves the racing action, as it makes the cars easier to watch.

Figure 2:
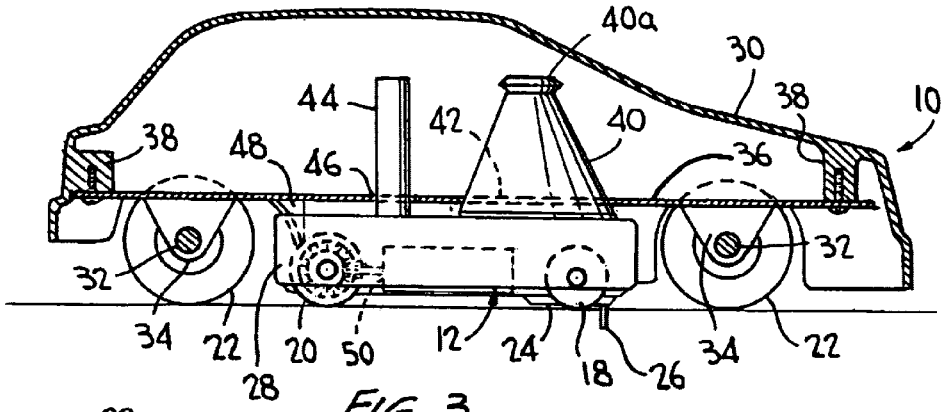
Figure 3:
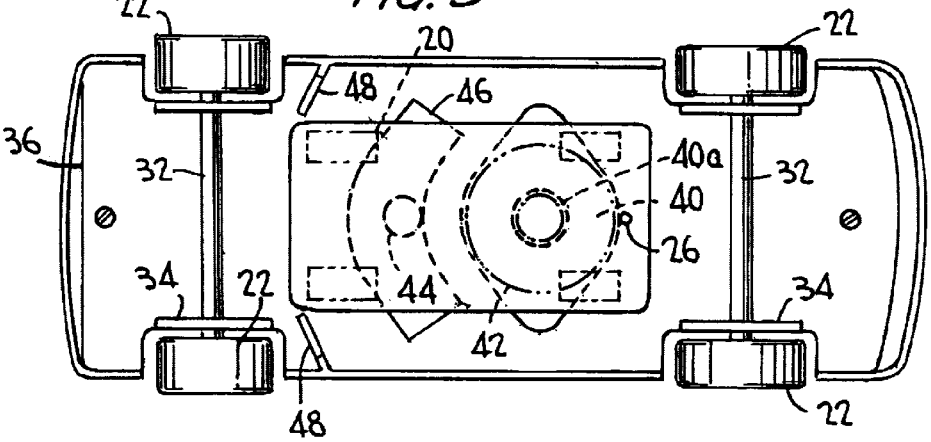
Figure 4:
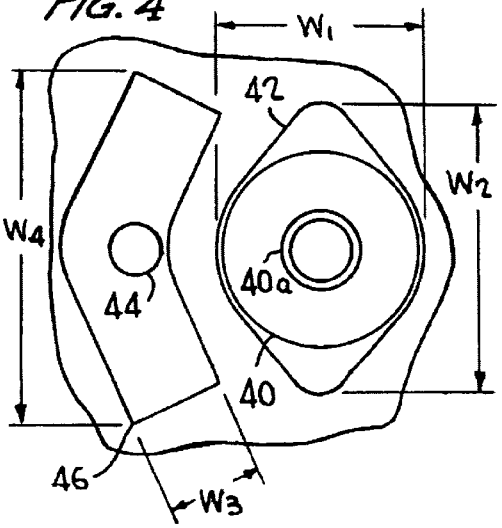
Figure 5:
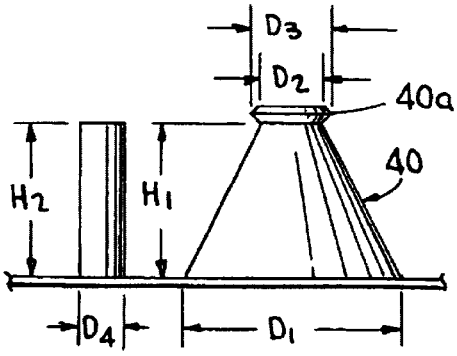

As illustrated, the visible car 10 comprises a body 30, molded of plastic. Visible wheels 22 are carried by axles 32 carried in bearers 34 affixed to a plate 36. As noted, wheels 22 are not driven, and are rotated only by incidental contact with the track 14. Plate 36 is affixed to body 30, e.g., by screws extending into bosses 38 formed integrally with body 30. When the visible car 10 is in its normal attitude with respect to sub body 12, plate 36 rests on the flat upper surface of housing 28; FIG. 2 shows them with a slight space therebetween, for clarity.

As noted above, it is desired to provide larger-scale visible cars running on smaller-scale track; in the preferred embodiment shown, the visible cars are of such large scale that they occupy more than half the width of the track. This would ordinarily prevent passing; however, because the visible cars are not fixed to the sub bodies (as noted, unlike all prior art of which the inventors are aware), and are relatively lightweight, as one car passes the other, one or both of the visible cars is jostled out of its normal attitude with respect to the respective sub body, allowing the cars to pass. The visible effect is very exciting, as the cars are seen to bump one another out of the way.

Several cooperating features are provided on the sub bodies and visible cars in order to allow the visible cars to be jostled out of their normal position with respect to the sub bodies 12, but urging the visible cars 10 to return to their normal attitudes on the sub bodies 12 after passing. That is, the visible cars are jostled out of alignment with their respective sub bodies during passing, but (in most cases) return to their normal attitudes immediately thereafter, that is, with plate 36 resting on the upper surface of sub body 12, and with the visible car aligned generally in the direction of travel of the vehicle. The overall effect is to provide exciting racing action, as the visible cars to some degree simulate a car "getting out of shape" during a racing manuever, and then returning to its normal attitude.

Figure 6:
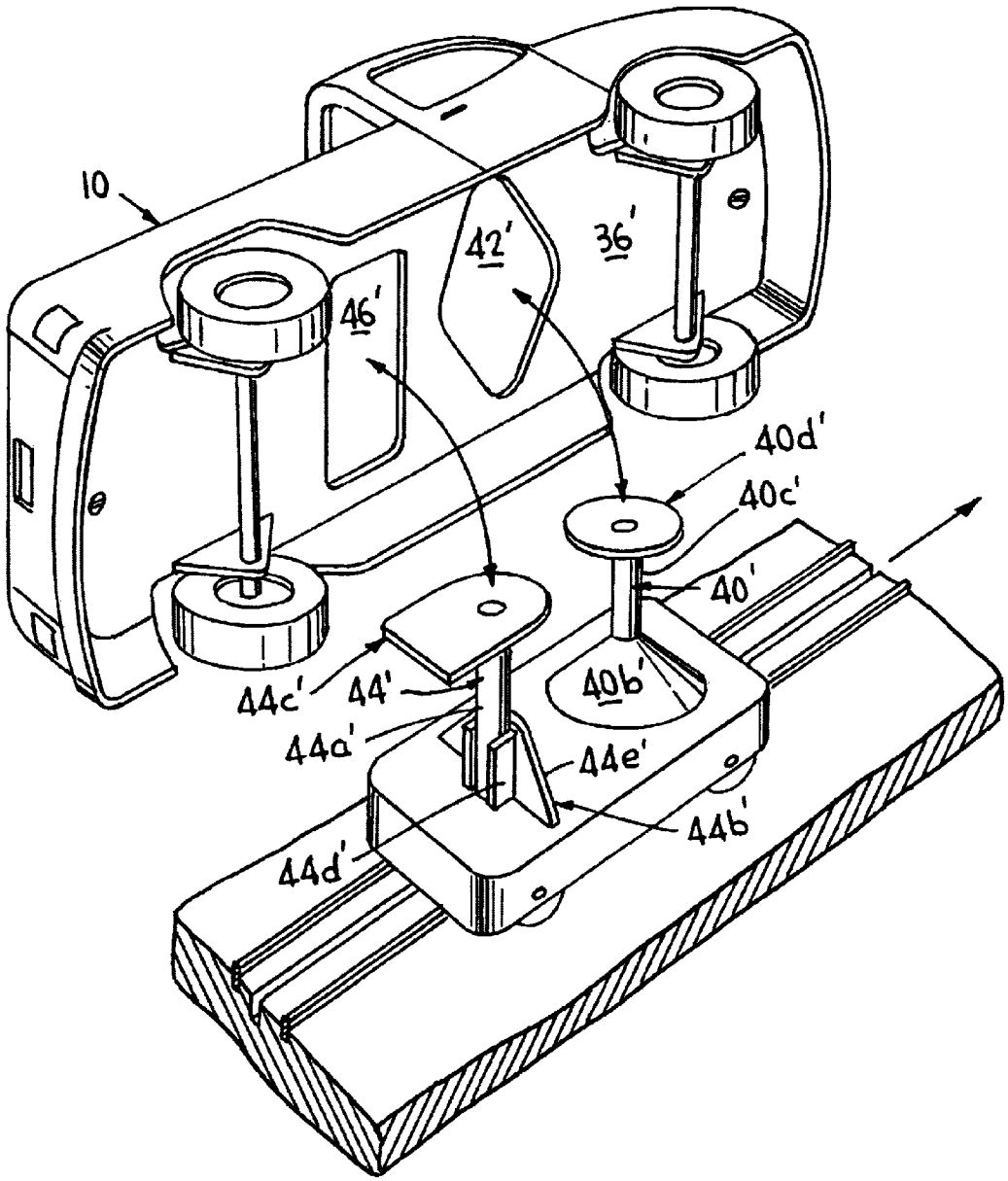
FIG. 6 shows a view corresponding to FIG. 1 and illustrates a slightly different second embodiment of the invention.

FIGS. 1–5 illustrate a first embodiment of the vehicles of the invention showing a first set of such cooperating features, while FIG. 6 shows a second embodiment illustrating several alternatives to these cooperating features. Other variations on these features are within the skill of the art. The discussion which follows focuses on the embodiment of FIGS. 1–5 in detail, with FIG. 6 being discussed briefly thereafter.

Referring therefore to FIGS. 1–5, the sub body 12 has a large, circularly symmetric, conical forward guide pin 40 fixed to its upper surface, which fits into a trapezoidal aperture 42 formed in plate 36, forming the underside of the visible car 10, as noted. Thus, as the visible car is jostled or bumped out of its normal attitude, the edge of aperture 42 slides up the conical surface of pin 40, and the visible car 10 tilts with respect to the sub body. The conical pin may have a cap 40*a* formed thereon, limiting the movement of visible car 10 relative to sub body 12, and preventing their separation in most cases. A second cylindrical rearward guide pin 44 is fixed to the sub body, behind the conical pin 40, and fits into an arcuate slot 46 in the plate 36; their cooperation limits the extent to which the visible car 10 can be displaced angularly from its normal forward orientation. Furthermore, arcuate guide members 48 may be formed on or affixed to either side of the plate 36, between the body of the visible car and the plate 36. The curved surfaces of guide members 48 bear on either side of sub body 12, tending to center the visible car thereon, so that the visible car 10 is approximately centered on the sub body 12. In order to provide relatively frictionless, free motion of the visible car with respect to the sub body, the guide pins 40 and 44, the plate 36, and the guide members 48 are all formed of plastic.

Accordingly, the visible car 10 can move in various directions with respect to the sub body, as the trapezoidal opening gives it substantial freedom of movement, limited only by the loose fit of the cylindrical pin 44 in the arcuate slot 46. More particularly, the conical surface of conical pin 40, and the arcuate guide members 48, provide a self-centering action to the visible car 10; after it has been jostled out of position, it tends to return to a normal attitude, that is, to be aligned with the sub body 12, and centered by arcuate guide members 48. Provision of the cylindrical pin 44 fitting within the arcuate slot 46 limits the angular excursion of the visible car 10 with respect to the sub body 12, so that the visible car 10 does not tend to be pushed too far out of axial alignment with the sub body 12. The result is that as two of these cars, which can be much larger than HO scale, bump one another during racing, the respective visible cars move with substantial freedom with respect to their respective sub bodies. More specifically, the visible cars are provided with freedom of motion in each of three dimensions; that is, they can roll (pivot about the longitudinal axis), pitch (pivot about a transverse axis) and yaw (pivot about a vertical axis) to a degree substantial enough to provide exciting attitude changes during racing. Further, in most collisions the visible cars are not separated from the sub bodies. The sub bodies themselves remain on the track with reasonable reliability, comparable to that of the conventional small-scale toy racing cars for which the chassis used for the cars of the invention are intended. Accordingly, the racing action is not interrupted unduly often.

In a successfully-tested implementation of the invention, the approximate dimensions of some of the key components (see FIGS. 4 and 5) are as follows:

Diameter $D_1$ of conical pin 40 at bottom: 0.975 inches

Diameter $D_2$ of conical pin 40 at top of conical portion: 0.340 inches

Diameter $D_3$ of conical pin 40 at maximum diameter of cap 40*a:* 0.530 inches Diameter $D_4$ of cylindrical pin 44: 0.250 inches Height $H_1$ of conical portion of pin 40: 0.740 inches Height $H_2$ of cylindrical pin 44: 0.780 inches Minor width $W_1$ of trapezoidal slot 42: 1.030 inches Major width $W_2$ of trapezoidal slot 42: 1.455 inches Minor width $W_3$ of arcuate slot 46: 0.470 inches Major width $W_4$ of arcuate slot 46: 1.625 inches.

As indicated above, these dimensions and the shapes of the conical pin 40, the cylindrical pin 44, the trapezoidal slot 42, the arcuate slot 46, and the arcuate guides 48 shown are not to be considered to limit the invention. Wide variation from the dimensions given and shapes shown can be expected to provide useful results not departing from the spirit of the invention, and realizing the advantages provided thereby.

FIG. 6 shows an example of such variation in the cooperating features provided according to the invention to allow motion of the visible body 10' with respect to the sub body 12', without excessively frequent separation thereof. As illustrated, in this embodiment the forward guide pin 40' fitting into the trapezoidal opening 42' in plate 36' comprises a conical lower portion 40*b'* and an upper cylindrical portion 40*c'*, which is capped by a much larger diameter cap 40*a'*. The cylindrical rear guide pin 44 and arcuate slot 46 of the FIGS. 1–5 embodiment are replaced by a rear guide assembly 44' and a rectangular opening 46' in plate 36', respectively. Guide assembly 44' comprises a columnar portion 44*a'*, which is preferably formed of a flexible rubber material. Columnar portion 44*a'* is supported by a stiffener/guide assembly comprising a transverse plate 44*b'* and paired longitudinal supports 44*d'* on either side of columnar member 44*a'*. Members 44*b'* and 44*d'* may be formed of plastic sheet and glued in place as illustrated. Accordingly, the flexible rubber columnar portion 44*a'* is permitted to flex only in the short section above the upper surface of transverse plate 44*b'*. Guide assembly 44' also comprises a cap member 44*c'*, of larger dimension in the direction of motion of the vehicle than the corresponding dimension of rectangular opening 46' in plate 36', and the height of guide assembly 44' is such that cap member is well above plate 36' when the visible body is assembled to sub body 12'. Accordingly, in this embodiment, the visible car 10' must be rotated, so that plate 44*c'* can pass into aperture 46', a and inclined with respect to the sub body 12' so that cap 40*a'* can pass into aperture 42', that is, in order to enable assembly of the visible car 10' to the sub body 12'. In turn this allows substantial displacement of visible car 10' with respect to sub body 12' during racing without their becoming separated. The angled "shoulders" 44*e'* formed on transverse plate 44*b'* cooperate with the lateral edges of the rectangular opening 46' to provide a self-centering action, as does the conical surface of portion 40*b'* of pin 40', cooperating with the edges of trapezoidal opening 42'. In practice the embodiment of the cooperating guide components shown in FIG. 6 allows substantially more vertical motion of the visible car 10' with respect to sub body 12' with separation thereof than provided by the embodiment of FIGS. 1–5.

Thus, the cooperating features provided on the visible car 10 and the sub body 12 allow substantial relative displacement thereof, providing realistic and exciting racing action, while reducing the frequency of detachment of the visible car from the sub body to a satisfactory level, and providing self-centering return of the visible body to its normal attitude after contact with another vehicle during racing. As mentioned, and as will be apparent to those of skill in the art, further variation in these cooperating features is within the scope of the invention.

To give some idea of the advantages provided by the invention, one typical standard HO slot car is approximately 1.720 inches long and 1.280 inches wide; the track center spacing is 1.500 inches, so two such cars can pass with about 0.2 inches between them. The sub bodies according to the invention are of approximately the same dimensions as the standard HO slot car; the visible cars, however, are 5.100 inches long and 2.270 inches wide. The visible cars in the example provided are also more than twice as tall as the standard HO car measured. The visible cars according to the invention, which overlap the track centers substantially, can still pass one another, and in so doing provide exciting racing action as one car may appear to go up on two wheels to pass the other, or may bump the other out of its way. Thus very exciting and realistic racing action is provided; car bodies much larger than HO scale can be used, improving the visual effect, while the motion of the vehicles is also very prototypical, and exciting for both driver and spectator. Moreover, the very substantial increase in the surface area of the visible cars (more than tenfold, in the example provided) provides that much more space for decoration, interesting paint schemes, and the like, and thus provides a significant opportunity for marketing of a "collectors" line of visible cars corresponding to popular race cars and the like.

While a preferred embodiment of the invention has been disclosed in detail, the invention is not to be limited thereby.

What is claimed is:

1. A toy racing vehicle, intended to be operated on a predetermined track comprising paired electrical conductors and a guiding groove, said vehicle comprising:

a sub body, said sub body comprising a chassis, said chassis comprising electrical pickup members for contacting said paired conductors, a motor connected to said pickup members, wheels driven by said motor, and a guide member adapted to cooperate with said guiding groove, and a visible car adapted to be supported on said sub body without being fixed thereto, wherein said sub body and said visible car comprise cooperating features for loosely retaining said visible car on said sub body, said cooperating features allowing motion of the visible car with respect to the sub body, and tending to urge said visible car toward a normal position with respect to said sub body; and wherein said chassis is designed to run on a predetermined track designed for the operation of toy racing cars of a first scale, and wherein the visible car is of substantially larger scale.

2. The vehicle of claim 1, wherein said visible car is on the order of at least 200% larger scale than the first scale of the toy racing cars with respect to which said chassis were designed to operate.

3. The vehicle of claim 1, wherein said visible car is of sufficiently larger scale than the first scale of the toy racing cars with respect to which said chassis was designed to operate that one such vehicle cannot overtake another on said predetermined track without contact therebetween.

4. The vehicle of claim 1, wherein said cooperating features comprised by said sub body and said visible car for loosely retaining said visible car on said sub body, allowing motion of the visible car with respect to the sub body, and tending to urge said visible car toward a normal position with respect to said sub body, comprise at least one guide pin carried by said sub body and fitting into an aperture formed in the underside of said visible car, and at least one conical member formed on said sub body and arranged to cooperate with an aperture formed in the underside of said visible car so as to urge said visible car toward a normal position with respect to said sub body.

5. The vehicle of claim 4, wherein said conical member is formed around said at least one guide pin.

6. The vehicle of claim 4, comprising a further guide pin mounted on said sub body and cooperating with a second aperture formed in the underside of said visible car.

7. The vehicle of claim 6, wherein at least one of said guide pins is provided with an end cap.

8. The vehicle of claim 7, wherein said apertures are formed in a plate defining a lower surface of said visible car, said plate resting on said sub body when said visible car is in its normal position with respect to said sub body.

9. The vehicle of claim 8, wherein at least one of said end caps has a dimension greater than the corresponding dimension of the corresponding aperture, said aperture having a greater dimension in a transverse direction, whereby said visible car must be rotated with respect to said sub body in order to insert said end cap into said aperture.

10. The vehicle of claim 6, wherein at least one of said guide pins is formed of a flexible, resilient material.

11. The vehicle of claim 10, wherein said flexible guide pin is supported over at least a portion of its length by stiffening structure, whereby only a predetermined portion of said guide pin is permitted to bend.

12. The vehicle of claim 11, wherein said stiffening structure further comprises opposed laterally-sloped surfaces cooperating with edges of the corresponding aperture to urge said visible car toward a normal position on said sub body.

13. The vehicle of claim 6, wherein said forward aperture is trapezoidal in outline.

14. The vehicle of claim 6, wherein said rearward aperture is arcuate in outline.

15. The vehicle of claim 6, wherein said rearward aperture is rectangular in outline.

16. The vehicle of claim 4, further comprising arcuate members affixed to the underside of said visible car and adapted to cooperate with edges of said sub body to urge said visible car toward a normal position with respect to said sub body.

* * * * *